US011125481B2

(12) United States Patent
Goel et al.

(10) Patent No.: US 11,125,481 B2
(45) Date of Patent: Sep. 21, 2021

(54) METHOD AND SYSTEM FOR CHARGE DETERMINATION

(71) Applicant: Lennox Industries Inc., Richardson, TX (US)

(72) Inventors: Rakesh Goel, Irving, TX (US); Siddarth Rajan, Chennai (IN); Patrie Ananda Balan, Chennai (IN)

(73) Assignee: Lennox Industries Inc., Richardson, TX (US)

( * ) Notice: Subject to any disclaimer, the term of this patent is extended or adjusted under 35 U.S.C. 154(b) by 86 days.

(21) Appl. No.: 16/578,609

(22) Filed: Sep. 23, 2019

(65) Prior Publication Data

US 2021/0088263 A1 Mar. 25, 2021

(51) Int. Cl.

| | |
|---|---|
| ***F25B 45/00*** | (2006.01) |
| ***F25B 49/00*** | (2006.01) |
| ***F24F 11/36*** | (2018.01) |
| *F25B 40/02* | (2006.01) |

(52) U.S. Cl.

CPC ..... *F25B 49/005* (2013.01); *F24F 11/36* (2018.01); *F25B 45/00* (2013.01); *F25B 40/02* (2013.01); *F25B 2345/003* (2013.01); *F25B 2500/222* (2013.01); *F25B 2700/21162* (2013.01); *F25B 2700/21163* (2013.01)

(58) Field of Classification Search

CPC ..... F25B 39/04; F25B 40/02; F25B 45/00; F25B 2345/003; F25B 2700/21163

See application file for complete search history.

(56) References Cited

U.S. PATENT DOCUMENTS

| | | | | |
|---|---|---|---|---|
| 2008/0011003 | A1* | 1/2008 | Douglas | F25B 41/40 62/149 |
| 2009/0025406 | A1* | 1/2009 | Yoshimi | F24F 11/83 62/127 |
| 2015/0267951 | A1* | 9/2015 | Berg | F25B 49/02 62/77 |
| 2015/0330685 | A1* | 11/2015 | Goel | G05D 16/2006 137/14 |
| 2020/0200457 | A1* | 6/2020 | Sata | F25B 1/00 |

* cited by examiner

*Primary Examiner* — Jonathan Bradford

(74) *Attorney, Agent, or Firm* — Shackelford, Bowen, McKinley & Norton, LLP

(57) ABSTRACT

An HVAC system includes an evaporator coil and a compressor fluidly coupled to the evaporator coil. A condenser coil is fluidly coupled to the compressor. The condenser coil includes at least one condenser circuit fluidly coupled between a discharge line and an exit manifold. A sub-cool circuit is fluidly coupled between the exit manifold and a liquid line. A first temperature sensor is disposed at an entrance to the sub-cool circuit. A second temperature sensor is disposed at an exit to the sub-cool circuit. An HVAC controller is operatively coupled to the first temperature sensor and the second temperature sensor. The HVAC controller is configured to determine a temperature difference across the sub-cool circuit.

20 Claims, 10 Drawing Sheets

METHOD AND SYSTEM FOR CHARGE DETERMINATION

TECHNICAL FIELD

The present disclosure relates generally to heating, ventilation, and air conditioning (HVAC) systems and more particularly, but not by way of limitation, to utilizing a temperature-drop measurement across a sub-cooling coil to determine an amount of refrigerant charge in an HVAC system.

BACKGROUND

This section provides background information to facilitate a better understanding of the various aspects of the disclosure. It should be understood that the statements in this section of this document are to be read in this light, and not as admissions of prior art.

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components, HVAC systems include a controller. In addition to directing operation of the HVAC system, the controller may be used to monitor various components, (i.e. equipment) of the HVAC system to determine if the components are functioning properly.

SUMMARY

Various aspects of the disclosure relate to a heating, ventilation, and air conditioning (HVAC) system. The HVAC system includes an evaporator coil and a compressor fluidly coupled to the evaporator coil. A condenser coil is fluidly coupled to the compressor. The condenser coil includes at least one condenser circuit fluidly coupled between a discharge line and an exit manifold. A sub-cool circuit is fluidly coupled between the exit manifold and a liquid line. A first temperature sensor is disposed at an entrance to the sub-cool circuit. A second temperature sensor is disposed at an exit to the sub-cool circuit. An HVAC controller is operatively coupled to the first temperature sensor and the second temperature sensor. The HVAC controller is configured to determine a temperature difference across the sub-cool circuit.

Various aspects of the disclosure relate to a condenser coil. The condenser coil includes at least one condenser circuit fluidly coupled between a discharge line and an exit manifold. A sub-cool circuit is fluidly coupled between the exit manifold and a liquid line. A first temperature sensor is disposed at an entrance to the sub-cool circuit. A second temperature sensor is disposed at an exit to the sub-cool circuit. An HVAC controller is operatively coupled to the first temperature sensor and the second temperature sensor. The HVAC controller is configured to determine a temperature difference across the sub-cool circuit. Responsive to the determined temperature difference, the HVAC controller determines if an HVAC system is one of undercharged or overcharged.

Various aspects of the disclosure relate to a method of charge management for an HVAC system. The method includes determining, with a first temperature sensor and a second temperature sensor, a temperature difference across a sub-cool circuit. A refrigerant charge is added to the HVAC system. Utilizing an HVAC controller, it is assessed if the refrigerant charge causes the temperature difference to increase or decrease. Responsive to a determination that the refrigerant charge causes the temperature difference to increase, additional refrigerant charge is added to the HVAC system. Responsive to a determination that the refrigerant charge causes the temperature difference to decrease, refrigerant charge is removed from the HVAC system.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

Figure 1:
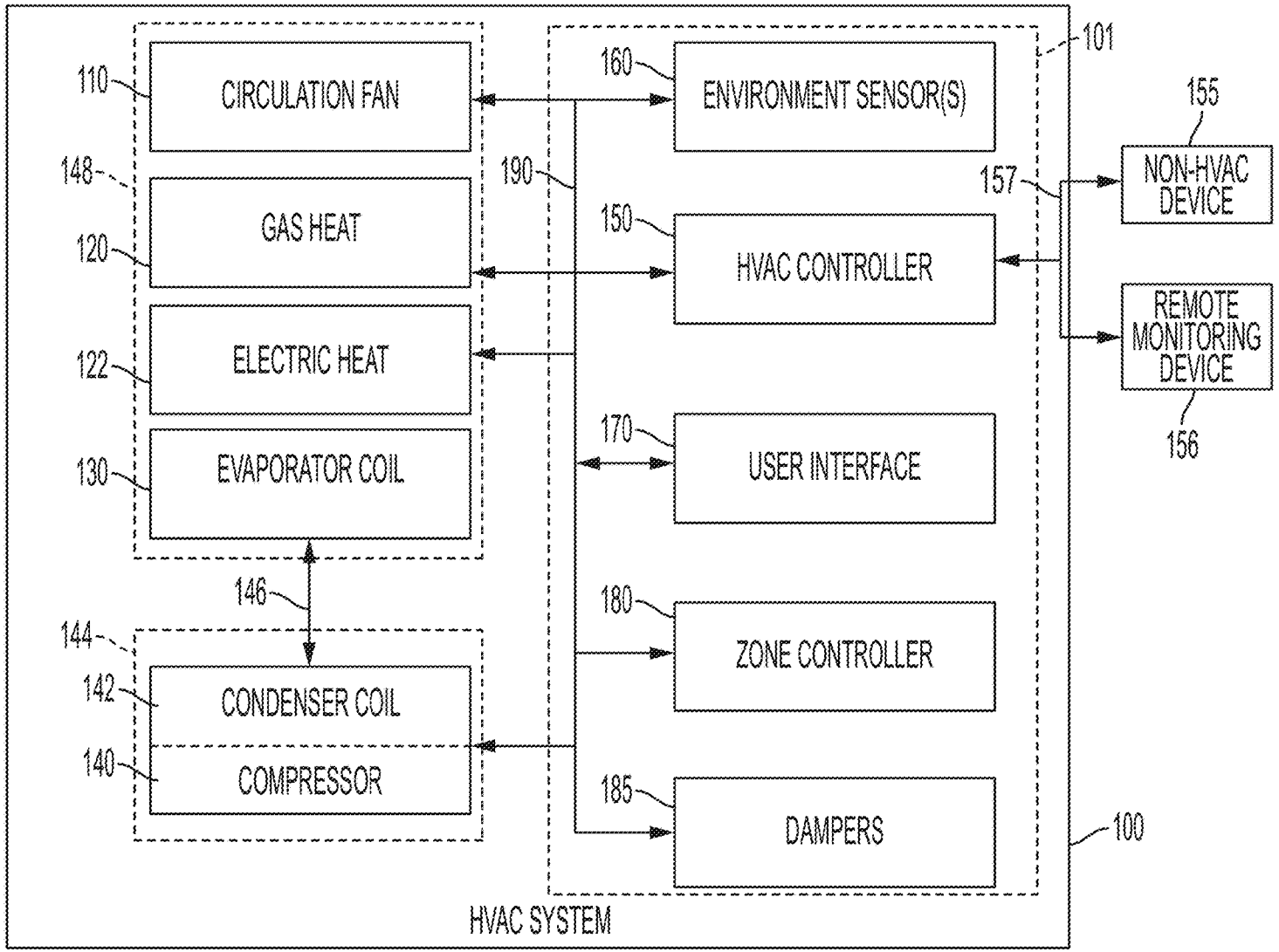
FIG. 1 is a block diagram of an exemplary HVAC system.

FIG. 1 illustrates an HVAC system 100. In a typical embodiment, the HVAC system 100 is a networked HVAC system that is configured to condition air via, for example, heating, cooling, humidifying, or dehumidifying air within an enclosed space 101. In a typical embodiment, the enclosed space 101 is, for example, a house, an office building, a warehouse, and the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but typically included within HVAC systems.

The HVAC system 100 includes a circulation fan 110, a gas heat 120, electric heat 122 typically associated with the circulation fan 110, and an evaporator coil 130, also typically associated with the circulation fan 110. The circulation fan 110, the gas heat 120, the electric heat 122, and the evaporator coil 130 are collectively referred to as an "indoor unit" 148. In a typical embodiment, the indoor unit 148 is located within, or in close proximity to, the enclosed space 101. The HVAC system 100 also includes a compressor 140 and an associated condenser coil 142, which are typically referred to as an "outdoor unit" 144. In various embodiments, the outdoor unit 144 is, for example, a rooftop unit or a ground-level unit. A rooftop unit is a type of HVAC system where the indoor unit 148 and the outdoor unit 144 are integral within a common housing. The compressor 140 and the associated condenser coil 142 are connected to an associated evaporator coil 130 by a refrigerant line 146. In a typical embodiment, the compressor 140 is, for example, a single-stage compressor or a multi-stage compressor. The circulation fan 110, sometimes referred to as a blower, is configured to operate at different capacities (i.e., variable motor speeds) to circulate air through the HVAC system 100, whereby the circulated air is conditioned and supplied to the enclosed space 101.

Still referring to FIG. 1, the HVAC system 100 includes an HVAC controller 150 that is configured to control operation of the various components of the HVAC system 100 such as, for example, the circulation fan 110, the gas heat 120, the electric heat 122, and the compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In a typical embodiment, the HVAC controller 150 cooperates with the zone controller 180 and the dampers 185 to regulate the environment of the enclosed space 101.

The HVAC controller 150 may be an integrated controller or a distributed controller that directs operation of the HVAC system 100. In a typical embodiment, the HVAC controller 150 includes an interface to receive, for example, thermostat calls, temperature setpoints, blower control signals, environmental conditions, and operating mode status for various zones of the HVAC system 100. For example, in a typical embodiment, the environmental conditions may include indoor temperature and relative humidity of the enclosed space 101. In a typical embodiment, the HVAC controller 150 also includes a processor and a memory to direct operation of the HVAC system 100 including, for example, a speed of the circulation fan 110.

Still referring to FIG. 1, in some embodiments, the plurality of environment sensors 160 are associated with the HVAC controller 150 and also optionally associated with a user interface 170. The plurality of environment sensors 160 provide environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, a relative humidity of the enclosed space 101, and calculate operational parameters of the HVAC system 100 as disclosed herein.

In a typical embodiment, the HVAC system 100 is configured to communicate with a plurality of devices such as, for example, a monitoring device 156, a communication device 155, and the like. In a typical embodiment, the monitoring device 156 is not part of the HVAC system. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In a typical embodiment, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and at least one user interface 170 such as, for example, the thermostat. The zone-controlled HVAC system 100 allows the user to independently control the temperature in the designated zones. In a typical embodiment, the zone controller 180 operates electronic dampers 185 to control air flow to the zones of the enclosed space 101.

In some embodiments, a data bus 190, which in the illustrated embodiment is a serial bus, couples various components of the HVAC system 100 together such that data is communicated therebetween. In a typical embodiment, the data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the circulation fan 110 or the plurality of environment sensors 160.

Figure 2:
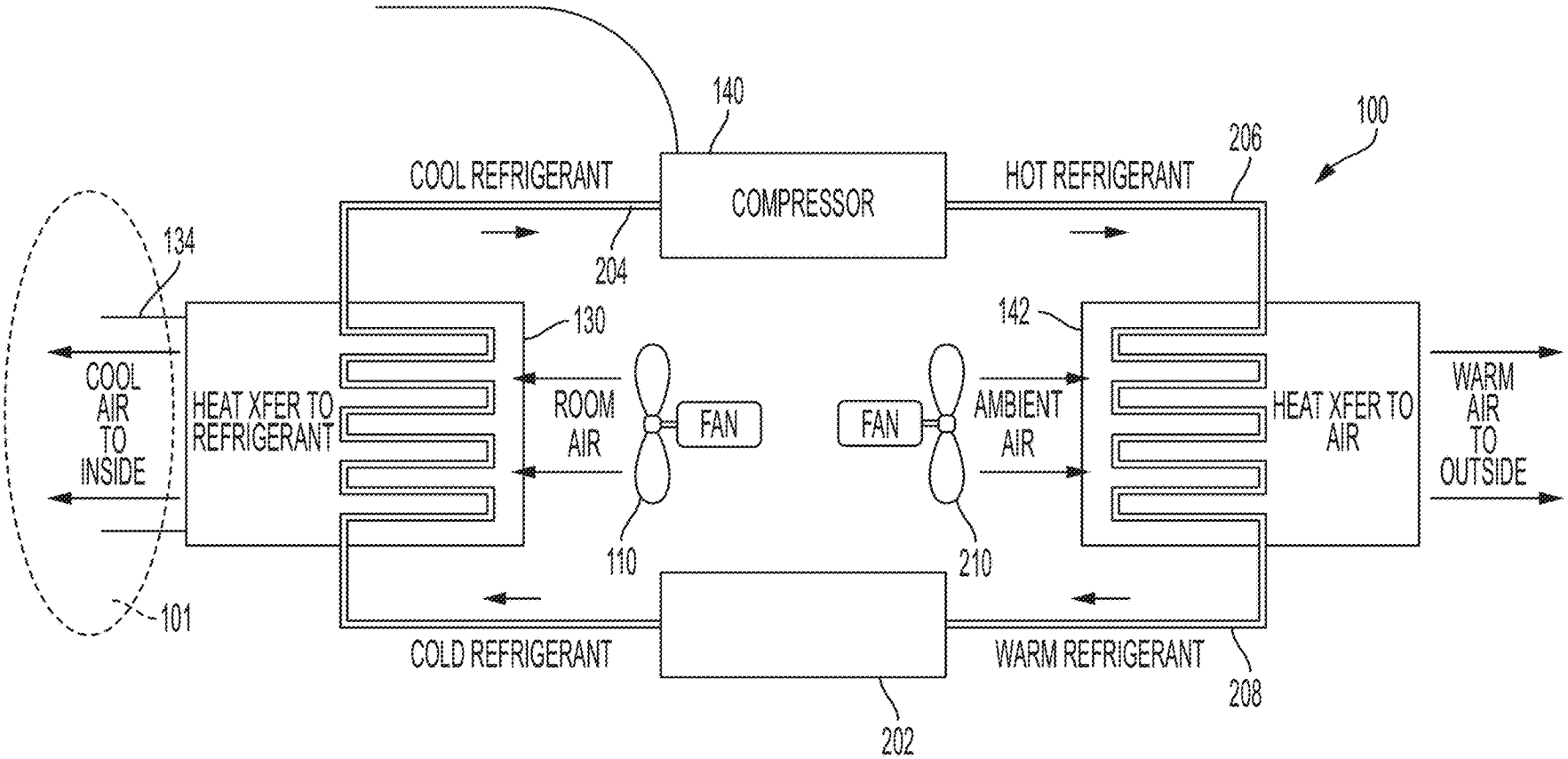
FIG. 2 is a schematic diagram of an exemplary HVAC system according to aspects of the disclosure.

FIG. 2 is a schematic diagram of the HVAC system 100. The HVAC system 100 includes the evaporator coil 130, the condenser coil 142, the compressor 140, and a metering device 202. During operation, the circulation fan 110 circulates air around the evaporator coil 130. In various embodiments, the compressor 140 is, for example, a single-stage compressor, a multi-stage compressor, a single-speed compressor, or a multi-speed compressor. The circulation fan 110, sometimes referred to as a blower, may, in various embodiments, be configured to operate at different capacities (i.e., variable motor speeds) to circulate air through the HVAC system 100, whereby the circulated air is conditioned and supplied to the enclosed space 101. In a typical embodiment, the metering device 202 is, for example, a thermostatic expansion valve or a throttling valve. The evaporator coil 130 is fluidly coupled to the compressor 140 via a suction line 204. The compressor 140 is fluidly coupled to the condenser coil 142 via a discharge line 206. The condenser coil 142 is fluidly coupled to the metering device 202 via a liquid line 208.

Still referring to FIG. 2, during operation, low-pressure, low-temperature refrigerant is circulated through the evaporator coil 130. The refrigerant is initially in a liquid/vapor state. In a typical embodiment, the refrigerant is, for example, R-22, R-134a, R-410A, R-744, or any other suitable type of refrigerant as dictated by design requirements. Air from within the enclosed space 101, which is typically warmer than the refrigerant, is circulated around the evaporator coil 130 by the circulation fan 110. In a typical embodiment, the refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant is introduced into the compressor 140 via the suction line 204. In a typical embodiment, the compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant leaves the compressor 140 via the discharge line 206 and enters the condenser coil 142.

Still referring to FIG. 2, outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, sub-cooled liquid state. After leaving the condenser coil 142, the high-pressure, sub-cooled refrigerant is at a temperature close to an ambient outside air temperature. The high-pressure, sub-cooled liquid refrigerant leaves the condenser coil 142 via the liquid line 208 and enters the metering device 202.

In the metering device 202, the pressure of the high-pressure, sub-cooled liquid refrigerant is abruptly reduced. In various embodiments where the metering device 202 is, for example, a thermostatic expansion valve, the metering device 202 reduces the pressure of the high-pressure, sub-cooled liquid refrigerant by regulating an amount of refrigerant that travels to the evaporator coil 130. Abrupt reduction of the pressure of the high-pressure, sub-cooled liquid refrigerant causes sudden, rapid, evaporation of a portion of the high-pressure, sub-cooled liquid refrigerant, commonly known as "flash evaporation." The flash evaporation lowers the temperature of the resulting liquid/vapor refrigerant mixture to a temperature lower than a temperature of the air in the enclosed space 101. The liquid/vapor refrigerant mixture leaves the metering device 202 and returns to the evaporator coil 130.

Figure 3:
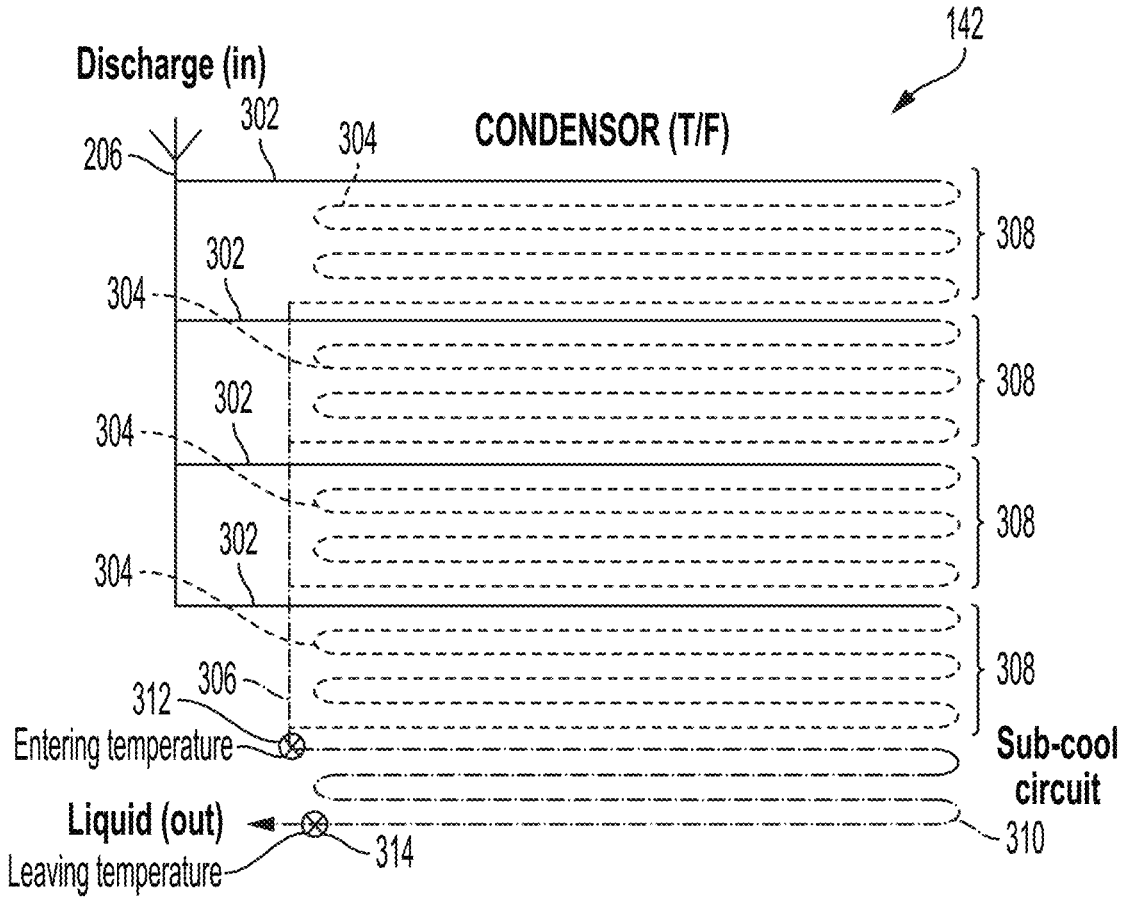
FIG. 3 is a schematic diagram of a condenser coil according to aspects of the disclosure.

FIG. 3 is a schematic diagram of the condenser coil 142. The condenser coil 142 is fed from the compressor 140 by the discharge line 206. The condenser coil 142 includes at least one inlet branch 302. The at least one inlet branch 302 is fluidly coupled to the discharge line 206. The at least one inlet branch 302 directs the high-pressure, high-temperature, superheated vapor refrigerant through a series of condenser loops 304 and into an exit manifold 306. The at least one inlet branch 302 and the series of condenser loops 304 define a condenser circuit 308. By way of example, the condenser coil 142, shown in FIG. 3, includes four condenser circuits 308; however, in other embodiments, the condenser coil 142 may include a single condenser circuit 308, between one and four condenser circuits 308, or more than four condenser circuits 308.

Still referring to FIG. 3, the exit manifold 306 directs the refrigerant into a sub-cool circuit 310. In the sub-cool circuit 310, the refrigerant is further cooled and changes state from a saturated liquid/vapor to a sub-cooled liquid. In various embodiments, the sub-cool circuit 310 facilitates state change of the refrigerant to a sub-cooled liquid under all conditions. Liquid refrigerant exits the condenser coil 142 via the liquid line 208. A first temperature sensor 312 is disposed in the exit manifold 306 at an entrance to the sub-cool circuit 310 and measures a temperature of refrigerant entering the sub-cool circuit 310. A second temperature sensor 314 is disposed at an exit of the sub-cool circuit 310 and measures a temperature of refrigerant leaving the sub-cool circuit 310. Thus, the first temperature sensor 312 and the second temperature sensor 314 facilitate measurement of a temperature difference across the sub-cool circuit 310. In various embodiments, the first temperature sensor 312 and the second temperature sensor 314 may be, for example, a thermometer, a thermocouple, a thermistor, a resistance temperature detector (RTD), an infrared sensor, or a semiconductor sensor.

Figure 4:
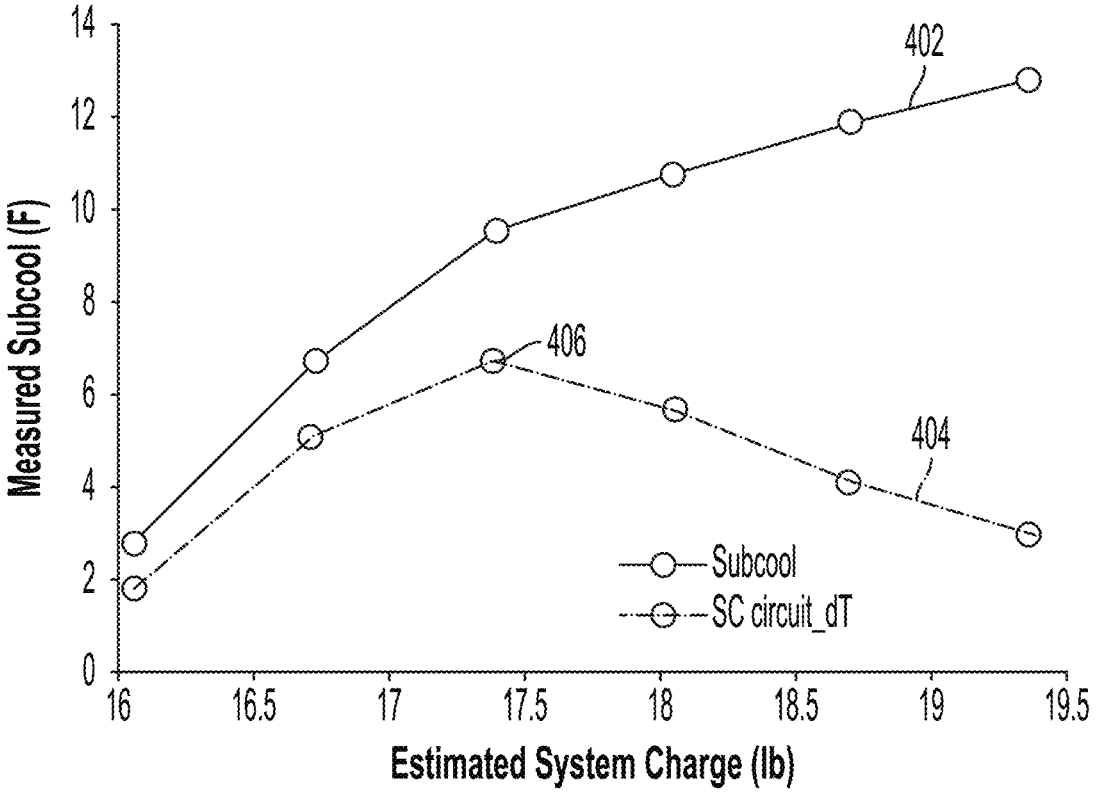
FIG. 4 is a graph illustrating how sub-cool temperature varies with an amount of refrigerant charge according to aspects of the disclosure.

FIG. 4 is a graph illustrating variation of sub-cool temperature with an amount of refrigerant charge. Line 402 illustrates variation of liquid sub-cool temperature. Liquid sub-cool temperature is defined as the difference between a saturated liquid temperature and the liquid temperature. As illustrated in FIG. 4, the liquid sub-cool temperature continues to rise with the addition of refrigerant charge. Line 404 illustrates variation of temperature difference across the sub-cool circuit 310. As illustrated in FIG. 4, the temperature difference across the sub-cool circuit 310 increases with the addition of refrigerant charge to a maximum temperature difference 406. Beyond the maximum temperature difference 406, the temperature difference across the sub-cool circuit decreases with the addition of more refrigerant charge. The maximum temperature difference 406 indicates the optimal amount of refrigerant charge in to the HVAC system 100. By of example, in the embodiment illustrated in FIG. 4, the optimal amount of refrigerant charge is approximately 17.3 lbs of refrigerant.

Figure 5:
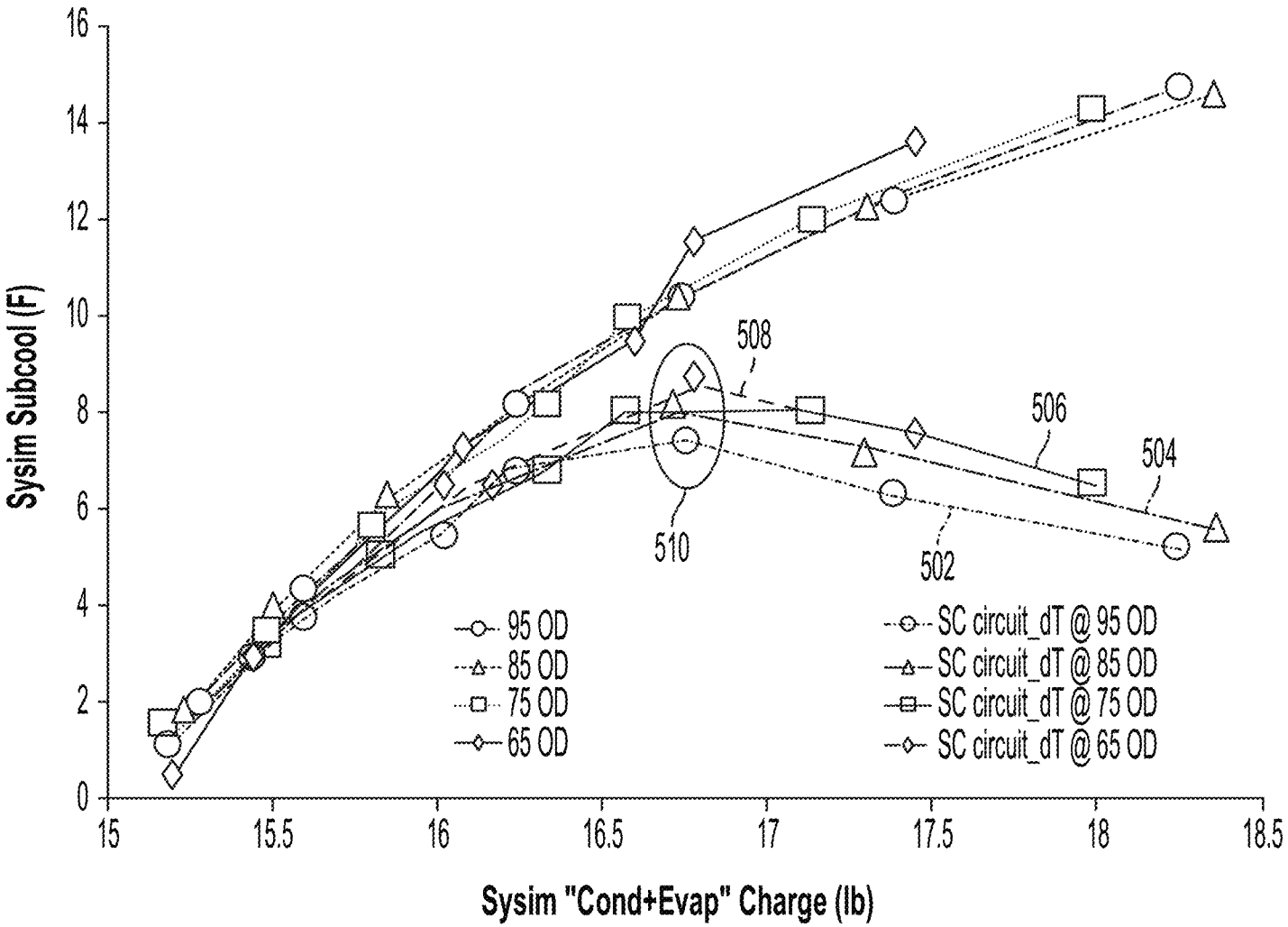
FIG. 5 is a graph illustrating how sub-cool temperature varies with an amount of refrigerant charge at various outdoor temperatures according to aspects of the disclosure.

FIG. 5 is a graph illustrating variation of temperature difference across the sub-cool circuit 310 with an amount of refrigerant charge at various outdoor temperatures. Line 502 illustrates temperature difference across the sub-cool circuit 310 at an outdoor temperature of 95° F. Line 504 illustrates temperature difference across the sub-cool circuit 310 at an outdoor temperature of 85° F. Line 506 illustrates temperature difference across the sub-cool circuit 310 at an outdoor temperature of 75° F. Line 508 illustrates temperature difference across the sub-cool circuit 310 at an outdoor temperature of 65° F. Lines 502, 504, 506, and 508 demonstrate minimal variations in the amount of refrigerant charge that corresponds to the maximum temperature difference 510 across the sub-cool circuit 310. Thus, FIG. 5 illustrates that the optimal amount of refrigerant charge is largely unaffected by outdoor temperature conditions.

Figure 6:
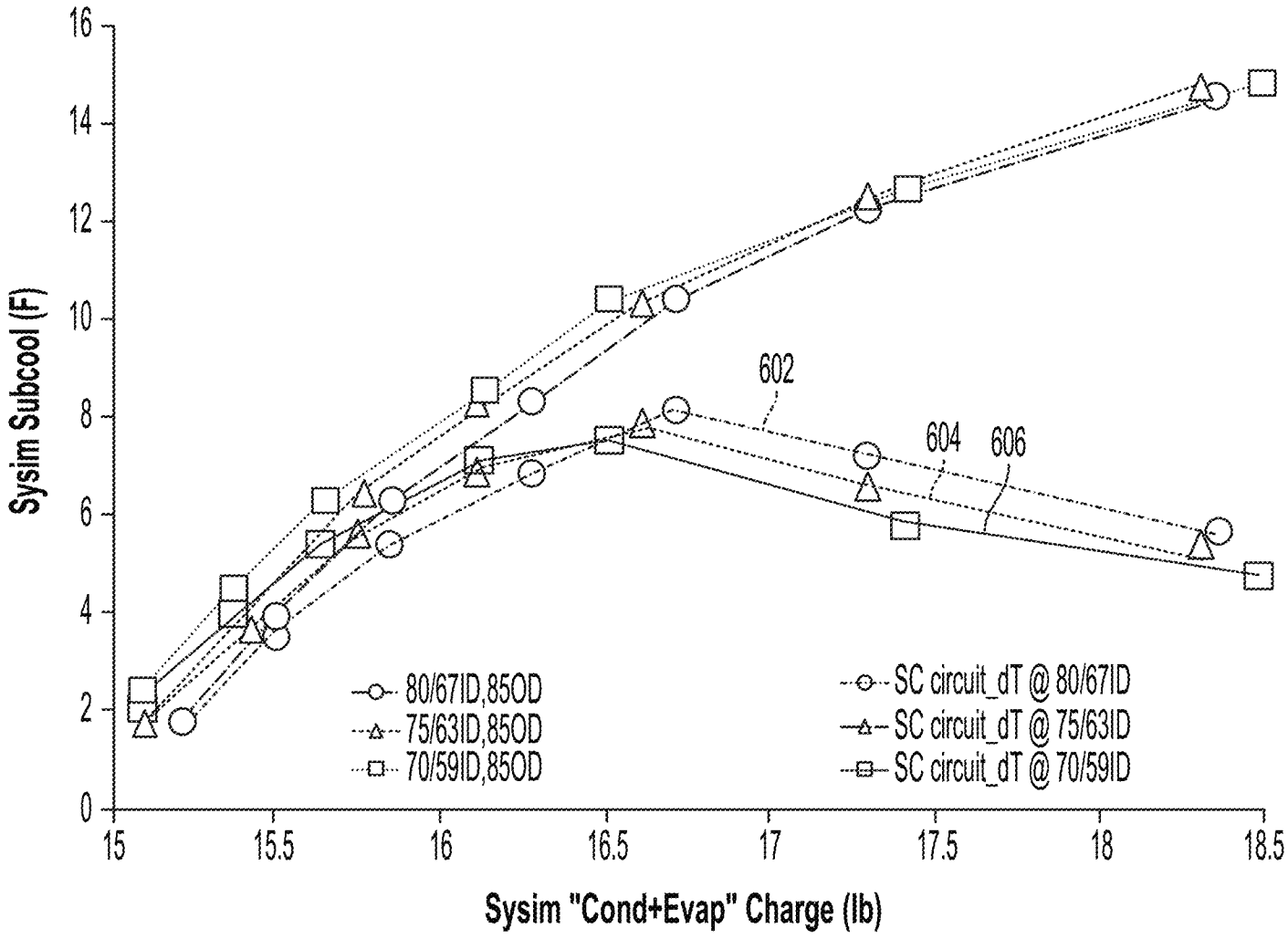
FIG. 6 is a graph illustrating how sub-cool temperature varies with an amount of refrigerant charge at various indoor temperatures according to aspects of the disclosure.

FIG. 6 is a graph illustrating variation of temperature difference across the sub-cool circuit 310 with an amount of refrigerant charge at various indoor temperatures. Line 602 illustrates temperature difference across the sub-cool circuit 310 at an indoor dry-bulb temperature of 80° F. and an indoor wet-bulb temperature of 67° F. (approximately 50% relative humidity). Line 604 illustrates temperature difference across the sub-cool circuit 310 at an indoor dry-bulb temperature of 75° F. and an indoor wet-bulb temperature of 63° F. (approximately 50% relative humidity). Line 606 illustrates temperature difference across the sub-cool circuit 310 at an indoor dry-bulb temperature of 70° F. and an indoor wet-bulb temperature of 59° F. (approximately 50% relative humidity). Lines 602, 604, and 606 demonstrate minimal variations in the amount of refrigerant charge that corresponds to the maximum temperature difference 608 across the sub-cool circuit 310. Thus, FIG. 6 illustrates that the optimal amount of refrigerant charge is largely unaffected by indoor temperature conditions.

Figure 7B:
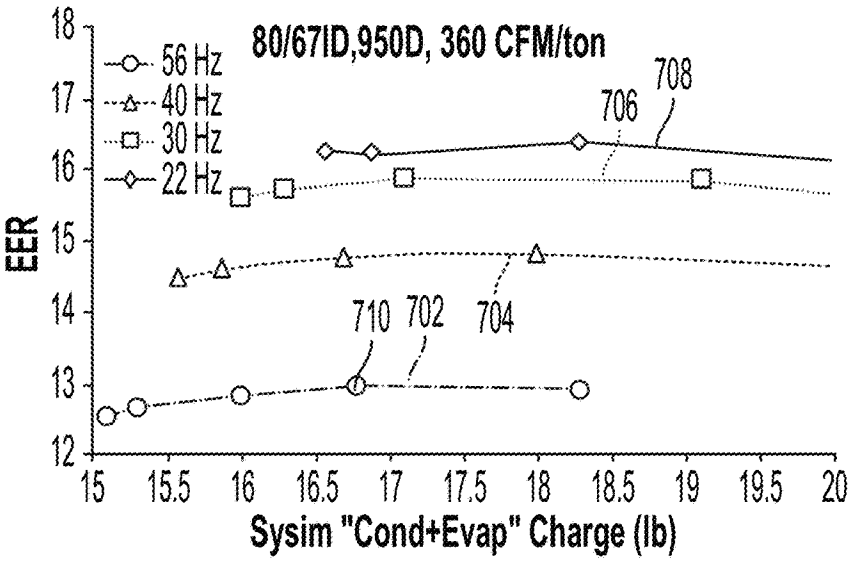
FIGS. 7A-7B are graphs illustrating variation of net capacity and energy efficiency ratio with an amount of refrigerant charge according to aspects of the disclosure.
Figure 7A:
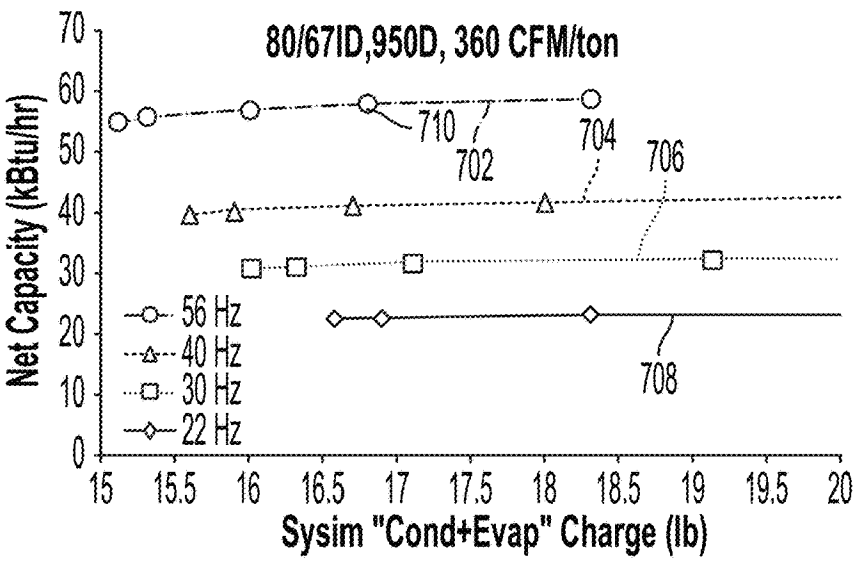

FIGS. 7A-7B are graphs illustrating variation of net capacity and energy efficiency ratio with an amount of refrigerant charge. Line 702 illustrates variation of net capacity and energy efficiency ratio when the compressor 140 is operating at 56 Hz. Line 704 illustrates variation of net capacity and energy efficiency ratio when the compressor 140 is operating at 40 Hz. Line 706 illustrates variation of net capacity and energy efficiency ratio when the compressor 140 is operating at 30 Hz. Line 708 illustrates variation of net capacity and energy efficiency ratio when the compressor 140 is operating at 22 Hz. Point 710 illustrates an optimal charge level yielding peak net capacity and efficiency of the HVAC system 100.

Figure 8:
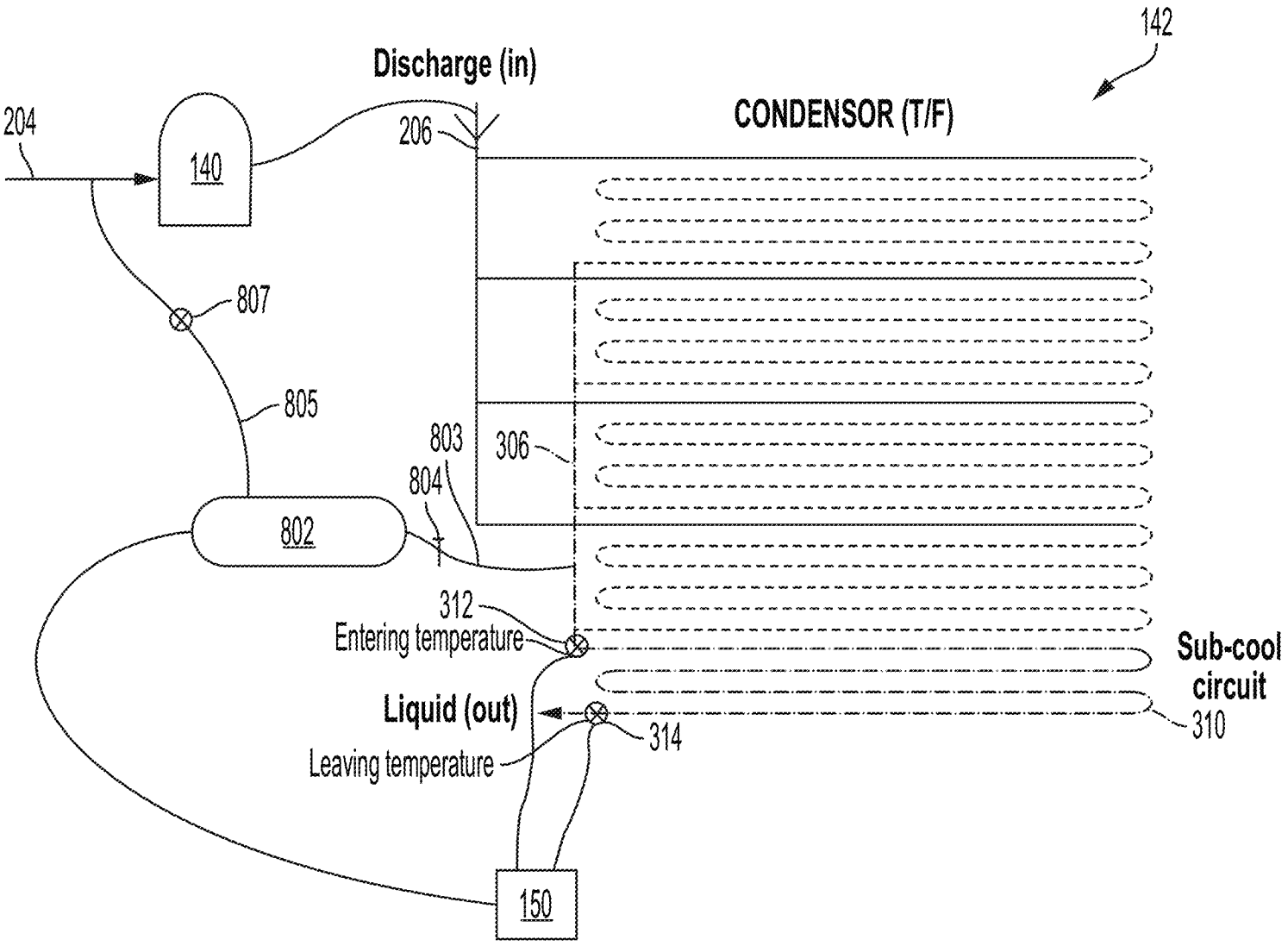
FIG. 8 is a schematic diagram of an active charge management system according to aspects of the disclosure.

FIG. 8 is a schematic diagram of an active charge management system 800. The active charge management system 800 includes the condenser coil 142 and the sub-cool circuit 310 described above with respect to FIG. 3. The first temperature sensor 312 and the second temperature sensor 314 are electrically coupled to the HVAC controller 150. A refrigerant reservoir 802 is fluidly coupled to the exit manifold 306 via a removal line 803. The refrigerant reservoir 802 is fluidly coupled to the suction line 204 via a filling line 805. A first valve 804 such as, for example, a solenoid valve, is disposed in the removal line 803 between the refrigerant reservoir 802 and the exit manifold 306 and, when closed, prevents flow of refrigerant between the exit manifold 306 and the refrigerant reservoir 802. The first valve 804 is electrically coupled to the HVAC controller 150. A second valve 807 such as, for example, a solenoid valve, is disposed in the filling line 805 between the refrigerant reservoir 802 and the suction line 204 and, when closed, prevents flow of refrigerant between the refrigerant reservoir 802 and the suction line 204. The second valve 807 is electrically coupled to the HVAC controller 150.

Still referring to FIG. 8, during operation, the first temperature sensor 312 and the second temperature sensor 314 transmit measurements of liquid refrigerant temperature at an inlet to the sub-cool circuit 310 and at an exit from the sub-cool circuit 310, respectively. The HVAC controller 150 utilizes the measurements from the first temperature sensor 312 and the second temperature sensor 314 to calculate a temperature difference across the sub-cool circuit 310.

Figure 9:
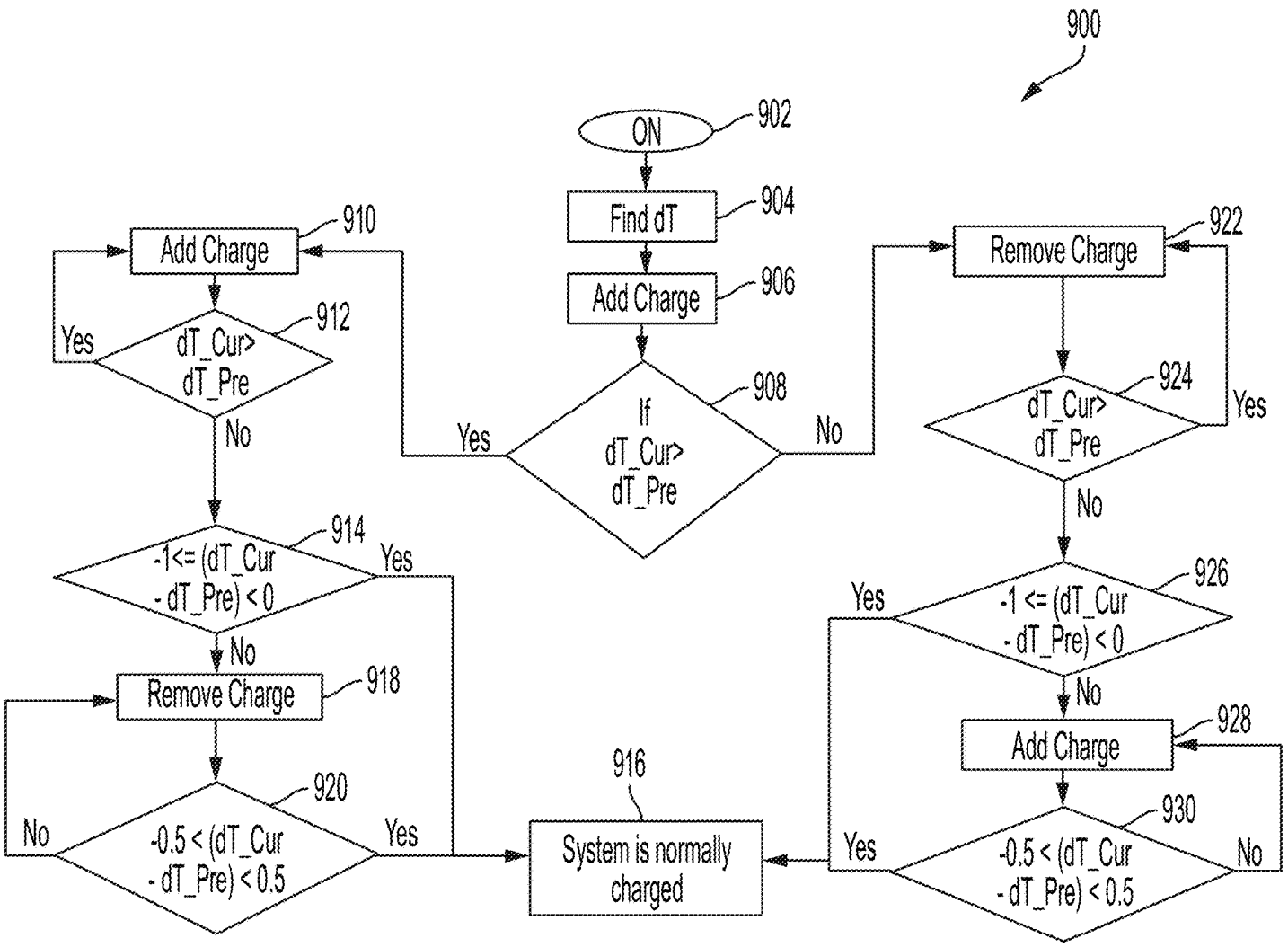
FIG. 9 is a flow diagram illustrating a process for active charge management according to aspects of the disclosure.

FIG. 9 is a flow diagram illustrating a process 900 for active charge management. The process 900 begins at step 902. At step 904, the HVAC controller 150 determines a temperature difference across the sub-cool circuit 310 based on temperature measurements from the first temperature sensor 312 and the second temperature sensor 314. At step 906, the HVAC controller directs the second valve 807 to open for a period of time to allow a fixed amount of additional refrigerant to be introduced from the refrigerant reservoir 802 to the suction line 204. In various embodiments, the suction line 204 is at a lower pressure than the refrigerant reservoir 802 thereby inducing flow of refrigerant from the refrigerant reservoir 802 to the suction line 204 when the second valve 807 is open. At step 908, it is determined if the temperature difference across the sub-cool circuit 310 is greater than the temperature difference measured in step 904.

Still referring to FIG. 9, if it is determined in step 908 that the temperature difference across the sub-cool circuit is greater than the temperature difference measured in step 904, then the HVAC system is undercharged and the process 900 proceeds to step 910. At step 910, the HVAC controller directs the second valve 807 to open for a period of time to allow a fixed amount of additional refrigerant to be introduced from the refrigerant reservoir 802 to the suction line 204. In various embodiments, the suction line 204 is at a lower pressure than the refrigerant reservoir 802 thereby inducing flow of refrigerant from the refrigerant reservoir 802 to the suction line 204 when the second valve 807 is open. At step 912, it is determined if the temperature difference across the sub-cool circuit is greater than the temperature difference measured at step 908. If, at step 912, it is determined that the temperature difference across the sub-cool circuit is greater than the temperature difference measured at step 908, the HVAC system remains undercharged and the process 900 returns to step 910. If, at step 912, it is determined that the temperature difference across the sub-cool circuit 310 is not greater than the temperature difference measured at step 908, then the process 900 proceeds to step 914. At step 914, it is determined if the difference between the temperature difference across the sub-cool circuit 310 and the temperature difference measured at step 908 is between −1 and 0. If it is determined at step 914 that the difference is between −1 and 0, then the HVAC system 100 is normally charged and the process 900 ends at step 916. If it is determined at step 914 that the difference is not between −1 and 0, then the HVAC system is overcharged and the process 900 proceeds to step 918. At step 918, the HVAC controller 150 directs the first valve 804 to open in an effort to remove refrigerant from the exit manifold 306 to the refrigerant reservoir 802. In various embodiments, the exit manifold 306 is at a higher pressure than the refrigerant reservoir 802 thereby inducing flow of refrigerant from the exit manifold 306 into the refrigerant reservoir 802 when the first valve 804 is open. At step 920, it is determined if the difference between the temperature difference across sub-cool circuit 310 and the temperature difference measured at step 914 is between −0.5 and 0.5. If, at step 920, it is determined that the difference is between −0.5 and 0.5, then the HVAC system 100 is normally charged and the process 900 ends at step 916. If, at step 920, it is determined that the difference is not between −0.5 and 0.5, then the process 900 returns to step 918.

Still referring to FIG. 9, if it is determined in step 908 that the temperature difference across the sub-cool circuit is not greater than the temperature difference measured in step 904, then the HVAC system is overcharged and the process 900 proceeds to step 922. At step 922, the HVAC controller directs the first valve 804 to open for a period of time to allow a fixed amount of refrigerant to be removed from the exit manifold 306 to the refrigerant reservoir 802. In various embodiments, the exit manifold 306 is at a higher pressure than the refrigerant reservoir 802 thereby inducing flow of refrigerant from the exit manifold 306 into the refrigerant reservoir 802 when the first valve 804 is open. At step 924, it is determined if the temperature difference across the sub-cool circuit is greater than the temperature difference measured at step 908. If, at step 924, it is determined that the temperature difference across the sub-cool circuit 310 is greater than the temperature difference measured at step 908, the HVAC system remains overcharged and the process 900 returns to step 922. If, at step 924, it is determined that the temperature difference across the sub-cool circuit 310 is not greater than the temperature difference measured at step 908, then the process 900 proceeds to step 926. At step 926, it is determined if the difference between the temperature difference across the sub-cool circuit 310 and the temperature difference measured at step 908 is between −1 and 0. If it is determined at step 926 that the difference is between −1 and 0, then the HVAC system 100 is normally charged and the process 900 ends at step 916. If it is determined at step 926 that the difference is not between −1 and 0, then the HVAC system is undercharged and the process 900 proceeds to step 928. At step 928, the HVAC controller 150 directs the second valve 807 to open in an effort to add refrigerant from the refrigerant reservoir 802 to the suction line 204. In various embodiments, the suction line 204 is at a lower pressure than the refrigerant reservoir 802 thereby inducing flow of refrigerant from the refrigerant reservoir 802 to the suction line 204 when the second valve 807 is open. At step 930, it is determined if the difference between the temperature difference across sub-cool circuit 310 and the temperature difference measured at step 926 is between −0.5 and 0.5. If, at step 930, it is determined that the difference is between −0.5 and 0.5, then the HVAC system 100 is normally charged and the process 900 ends at step 916. If, at step 930, it is determined that the difference is not between −0.5 and 0.5, then the process 900 returns to step 928.

Figure 10:
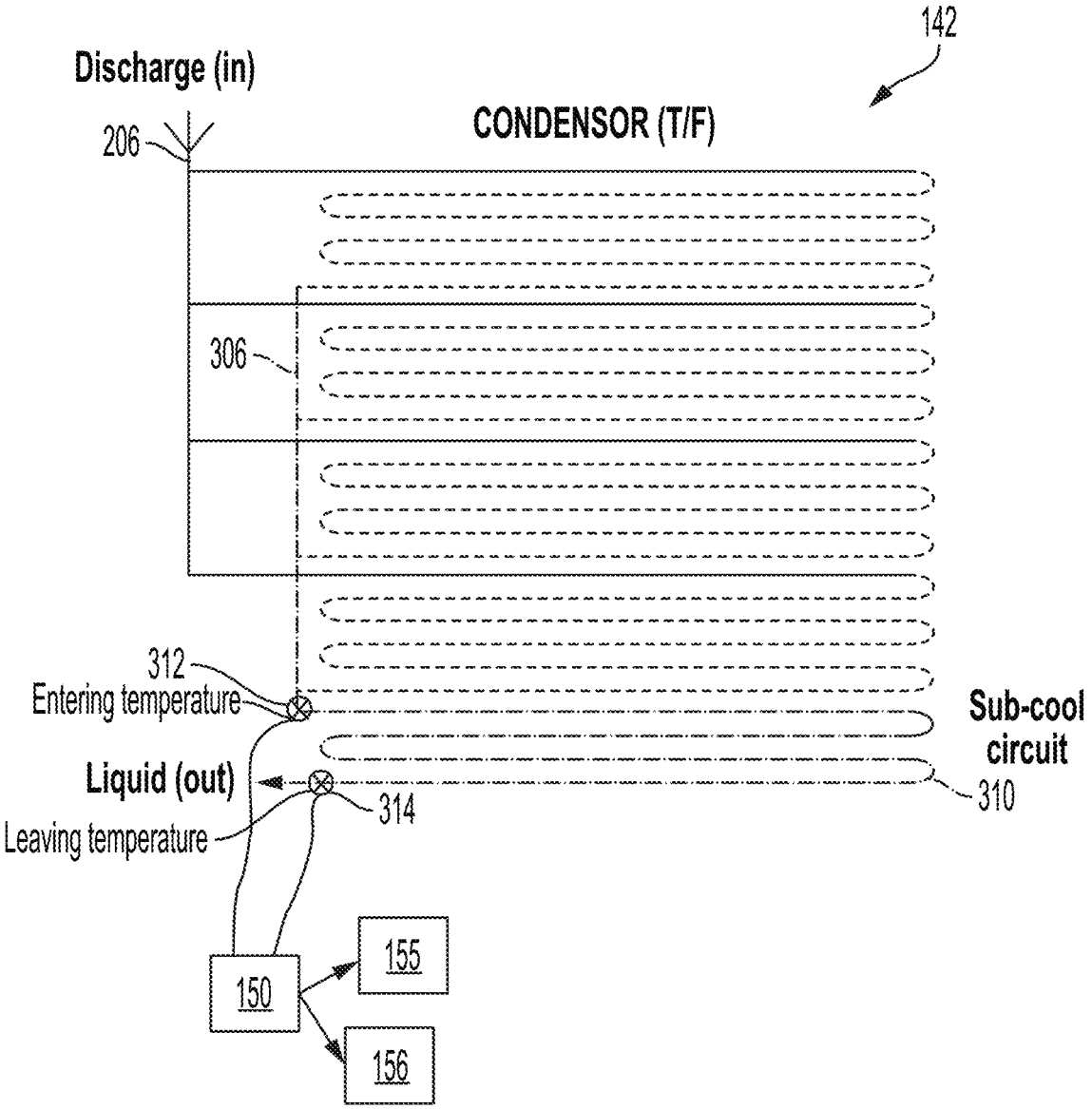
FIG. 10 is a schematic diagram of a loss-of-charge detection system according to aspects of the disclosure.

FIG. 10 is a schematic diagram of a loss-of-charge detection system 1000. The loss-of-charge detection system 1000 includes the condenser coil 142 and the sub-cool circuit 310 described above with respect to FIG. 3. The first temperature sensor 312 and the second temperature sensor 314 are electrically coupled to the HVAC controller 150. During operation, the first temperature sensor 312 and the second temperature sensor 314 transmit measurements of liquid refrigerant temperature at an inlet to the sub-cool circuit 310 and at an exit from the sub-cool circuit 310, respectively. The HVAC controller 150 utilizes the measurements from the first temperature sensor 312 and the second temperature sensor 314 to calculate a temperature difference across the sub-cool circuit 310. If the HVAC controller 150 detects a decrease in the magnitude of the temperature difference, the HVAC controller 150 determines that a loss of refrigerant charge is possible. The HVAC controller 150 generates an alert signaling a possible loss of refrigerant charge. In various embodiments, the alert could be an auditory or visual alert. In other embodiments, the alert could include a message delivered to the communication device 155 or the monitoring device 156.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within a percentage of" what is specified.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently. e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A heating, ventilation, and air conditioning (HVAC) system comprising:
- an evaporator coil;
- a compressor fluidly coupled to the evaporator coil;
- a condenser coil fluidly coupled to the compressor, the condenser coil comprising:
  - at least one condenser circuit fluidly coupled between a discharge line and an exit manifold;
  - a sub-cool circuit fluidly coupled between the exit manifold and a liquid line;
  - a first temperature sensor disposed at an entrance to the sub-cool circuit;
  - a second temperature sensor disposed at an exit to the sub-cool circuit; and
- an HVAC controller operatively coupled to the first temperature sensor and the second temperature sensor, the HVAC controller configured to:
  - determine a first temperature difference across the sub-cool circuit;
  - add a refrigerant charge to the HVAC system;
  - determine a second temperature difference across the sub-cool circuit;
  - determine if the second temperature difference is greater than the first temperature difference;
  - responsive to a determination that the second temperature difference is greater than the first temperature difference, add additional refrigerant charge to the HVAC system; and
  - responsive to a determination that the second temperature difference is not greater than the first temperature difference, remove refrigerant charge from the HVAC system.

2. The HVAC system of claim 1, wherein the HVAC controller is configured to generate an alert responsive to a change in a temperature difference.

3. The HVAC system of claim 1, comprising a refrigerant reservoir fluidly coupled to the exit manifold.

4. The HVAC system of claim 3, comprising a first valve disposed between the refrigerant reservoir and the exit manifold and a second valve disposed between the refrigerant reservoir and a suction line.

5. The HVAC system of claim 4, wherein the first valve and the second valve are operatively coupled to the HVAC controller.

6. The HVAC system of claim 5, wherein the HVAC controller is configured to at least one of add refrigerant to the HVAC system via the second valve and remove refrigerant from the HVAC system via the first valve.

7. A condenser coil comprising:
- at least one condenser circuit fluidly coupled between a discharge line and an exit manifold;
- a sub-cool circuit fluidly coupled between the exit manifold and a liquid line;
- a first temperature sensor disposed at an entrance to the sub-cool circuit;
- a second temperature sensor disposed at an exit to the sub-cool circuit;
- an HVAC controller operatively coupled to the first temperature sensor and the second temperature sensor, the HVAC controller configured to:
  - determine a first temperature difference across the sub-cool circuit;
  - add a refrigerant charge to the HVAC system;
  - determine a second temperature difference across the sub-cool circuit;
  - determine if the second temperature difference is greater than the first temperature difference;
  - responsive to a determination that the second temperature difference is greater than the first temperature difference, add additional refrigerant charge to the HVAC system; and
  - responsive to a determination that the second temperature difference is not greater than the first temperature difference, remove refrigerant charge from the HVAC system.

8. The condenser coil of claim 7, where in the at least one condenser circuit comprises a plurality of condenser circuits.

9. The condenser coil of claim 7, wherein the HVAC controller is configured to generate an alert responsive to a change in a temperature difference.

10. The condenser coil of claim 7, comprising a refrigerant reservoir fluidly coupled to the exit manifold.

11. The condenser coil of claim 10, comprising a first valve disposed between the refrigerant reservoir and the exit manifold and a second valve disposed between the refrigerant reservoir and a suction line.

12. The condenser coil of claim 11, wherein the first valve and the second valve are operatively coupled to the HVAC controller.

13. The condenser coil of claim 12, wherein the HVAC controller is configured to at least one of add refrigerant to the HVAC system via the second valve and remove refrigerant from the HVAC system via the first valve.

14. A method of charge management for an HVAC system, the method comprising:
- determining, with a first temperature sensor and a second temperature sensor, a first temperature difference across a sub-cool circuit;
- adding a refrigerant charge to the HVAC system;
- determining, with the first temperature sensor and the second temperature sensor, a second temperature difference across the sub-cool circuit;
- determining, with an HVAC controller, if the second temperature difference is greater than the first temperature difference;

responsive to a determination that the second temperature difference is greater than the first temperature difference, adding additional refrigerant charge to the HVAC system; and responsive to a determination that the second temperature difference is not greater than the first temperature difference refrigerant charge causes the temperature difference to decrease, removing refrigerant charge from the HVAC system.

15. The method of claim 14, wherein the HVAC controller directs the adding additional refrigerant to the HVAC system via a second solenoid valve electrically coupled to the HVAC controller and fluidly coupled between a refrigerant reservoir and a suction line.

16. The method of claim 15, wherein the HVAC controller directs the removing refrigerant to the HVAC system via a first solenoid valve electrically coupled to the HVAC controller and fluidly coupled between the refrigerant reservoir and the exit manifold.

17. The method of claim 14, comprising generating an alert responsive to a change in a temperature difference.

18. The method of claim 17, further comprising:

determining, with the first temperature sensor and the second temperature sensor, a third temperature difference across the sub-cool circuit;

determining, with the HVAC controller, if the third temperature difference is greater than the second temperature difference;

responsive to a determination that the third temperature difference is greater than the second temperature difference, adding additional refrigerant charge to the HVAC system; and responsive to a determination that the third temperature difference is not greater than the second temperature difference, determining with the HVAC controller, if the third temperature difference is between −1 and 0;

responsive to a determination that the third temperature difference is between −1 and 0, operating the HVAC system without adding or removing refrigerant charge; and responsive to a determination that the third temperature difference is not between −1 and 0, removing refrigerant charge from the HVAC system.

19. The method of claim 17, wherein the alert is transmitted to a communication device.

20. The method of claim 17, wherein the alert is transmitted to a monitoring device.

* * * * *